US005279230A

United States Patent [19]

Thomas et al.

[11] Patent Number: 5,279,230

[45] Date of Patent: Jan. 18, 1994

[54] RAILROAD WELL CAR BODY

[75] Inventors: Gareth R. Thomas; Charles C. Hill, both of Del Mar, Calif.; Gregory J. Saxton, Portland, Oreg.; Kenneth L. Weselake, San Diego, Calif.

[73] Assignee: Gunderson, Inc., Portland, Oreg.

[21] Appl. No.: 982,289

[22] Filed: Nov. 24, 1992

[51] Int. Cl.[5] ..... B61D 3/00

[52] U.S. Cl. ..... 105/355; 105/404; 105/422; 105/418; 105/419

[58] Field of Search ..... 105/355, 396, 404, 413, 105/414, 418, 429, 421, 422, 419; 410/52, 54, 68

[56] References Cited

U.S. PATENT DOCUMENTS

| | | | |
|---|---|---|---|
| 1,696,332 | 12/1928 | Sheehan . | |
| 1,875,584 | 9/1932 | Frede et al. . | |
| 2,052,213 | 8/1936 | Branstrator | 105/422 |
| 3,102,613 | 9/1963 | Johnston | 105/422 |
| 3,152,667 | 10/1964 | Johnston | 105/422 |
| 3,357,371 | 12/1967 | Gutridge | 105/366 |
| 3,420,192 | 1/1969 | Ellis | 105/422 |
| 4,091,742 | 5/1978 | Corani | 105/366 |
| 4,288,957 | 9/1981 | Meehan | 105/422 |
| 4,456,413 | 6/1984 | Pavlick | 410/56 |
| 4,686,907 | 8/1987 | Woollam et al. | 105/418 |
| 4,703,699 | 11/1987 | Hill | 105/355 |
| 4,771,706 | 9/1988 | Lindauer et al. | 105/415 |
| 4,782,762 | 11/1988 | Johnstone et al. | 137/355 |
| 4,862,810 | 9/1989 | Jamrozy et al. | 105/355 |
| 4,876,968 | 10/1989 | Lindauer et al. | 105/415 |
| 4,889,055 | 12/1989 | Jamrozy et al. | 105/355 |
| 4,949,646 | 8/1990 | Jamrozy et al. | 105/406 |
| 4,966,082 | 10/1990 | Takeichi et al. | 105/422 |

FOREIGN PATENT DOCUMENTS

| | | | |
|---|---|---|---|
| 0392828 | 10/1990 | European Pat. Off. | 105/396 |

OTHER PUBLICATIONS

"Honeycomb Wall Panels", Popular Mechanics, Jul. 1946, p. 147.

*Primary Examiner*—Mark T. Le

*Attorney, Agent, or Firm*—Chernoff, Vilhauer, McClung & Stenzel

[57] ABSTRACT

A railroad freight car including a cargo well for carrying optionally either intermodal cargo containers or highway semitrailers has a side sill structure including a deep rectangular top chord and a depending web, supporting a well floor structure. The well floor structure includes reinforcing longitudinal and transverse channel members and horizontal top and bottom plates attached to the channels. Large circular openings, aligned with one another, are defined in both the top and bottom plates, and a peripheral ring of vertical material interconnects the margins of the top and bottom plates around the openings, providing a light but stiff floor structure with a small vertical height.

20 Claims, 9 Drawing Sheets

RAILROAD WELL CAR BODY

BACKGROUND OF THE INVENTION

The present inventions relates to railroad freight cars, and particularly to a well car of light-weight construction, for optionally carrying either intermodal cargo containers stacked one upon another or over-the-highway trailers supported on their own running gear in the well.

Railroad cars for carrying over-the-highway trailers are well known, as are railroad freight cars defining container wells for carrying various combinations of intermodal cargo containers stacked one upon another in two tiers. Because the total weight which can be carried upon the rails limits the net amount of cargo which can be carried on a railroad freight car, it is desirable for a well car to be constructed in a configuration having a minimum tare weight consistent with the strength required to safely support a combination of cargo containers for which the car is configured. It is also necessary, however, to provide an adequate surface to support the tires of trailers carried in the cargo well. Additionally, it is necessary for a car to be strong enough to withstand the many forces resulting from movement of the laden car as part of a train.

It is desired, then, to provide a well car having a floor defining an area sufficiently large and strong to support the wheels of laden trailers and also capable of carrying the concentrated stresses resulting from carriage of intermodal cargo containers, while still having a minimum tare weight.

It is also desirable to provide a well floor structure whose vertical height, or overall thickness, is kept small, in order to minimize overall height of the well car when it is laden with containers stacked atop one another.

It is also necessary to provide a shallow well depth from floor top surface to the top of side sill giving trailer loading equipment access to the bottom of a trailer floor above the side sills so that trailers can be inserted into and extracted from the well. The reduction of bending resistance resulting from shallower side sills must be restored by other structure.

In the past, well floor structures of satisfactory rigidity to support trailers have been more massive and greater in vertical thickness than is desired for well floor structures in a car intended to carry intermodal cargo containers stacked in two tiers, where the height of the center of gravity and the overall height of such a car when laden are of concern.

One of the particular problems encountered in the past in attempting to design a well car with a light, thin, and yet stiff and strong well floor has been the question of how to provide adequate strength in the areas of interconnection of such a well floor with the structure of the sides and end portions of such a car.

Previous attempts to provide the dual capacity for carrying containers or trailers have included cars incorporating transverse beams supporting substantial gratings on which to receive the tires of a trailer carried in the well, as disclosed in Pavlick U.S. Pat. No. 4,456,413. While such cars provide ample strength for carrying both containers and trailers, the structure is undesirably heavy, and the well floor thickness is greater than desired, leaving less than the desired amount of vertical space available for stacked cargo containers. The car disclosed in Gutridge U.S. Pat. No. 3,357,371 has a similar lack of vertical clearance.

Jamrozy U.S. Pat. No. 4,949,646, and Lindauer et al. U.S. Pat. Nos. 4,876,968 and 4,771,706 all disclose a well car for carrying containers, in which a well floor structure includes transverse floor beams. Johnstone et al. U.S. Pat. No. 4,782,762 discloses a well car including a floor with longitudinal and transverse beams, for carrying containers. Cordani U.S. Pat. No. 4,091,742 discloses a well car including a floor structure of transverse and diagonal beams for supporting containers, but none of these patents discloses structure for supporting the wheels of a trailer carried in such a well.

Jamrozy et al. U.S. Pat. Nos. 4,889,055 and 4,862,810 disclose a well car including longitudinal channels, transverse channels, and a longitudinal center plate in a well floor structure, but there is no disclosure of structure available to support the wheels of a trailer in the container well.

Hill U.S. Pat. No. 4,703,699 discloses a lightweight side sill structure for a well car for carrying stacked containers, in which an opening is provided in one of a pair of parallel sheets of material, and a stiffener ring surrounding the opening connects the margins of the opening with the other of the two parallel sheets of material.

Other cars, such as those operated by Canadian National Railroad as its CN679500 "Improved Laser" series cars include heavy gratings supported on the flanges of hat-shaped transverse beams, providing structure of ample strength but greater than desired well floor thickness and weight.

What is needed, then, is an improved structure for a railroad well car body for optionally carrying either stacked containers or trailers, in which a well floor structure and the connection of such a well floor to other parts of the car provide adequate strength without unnecessary weight and with shallow well depth and small floor thickness.

SUMMARY OF THE INVENTION

The present invention provides an answer to the needs enumerated above and overcomes the aforementioned shortcomings of the prior art by providing a railroad freight car body having a cargo well defined by a pair of shallow longitudinal side sills of lightweight construction supporting a well floor of unified, lightened, and stiffened structure attached to the side sills to form a light, yet strong and stiff, car body structure. Such a car is capable of withstanding the concentrated loads imposed by cargo containers and has the necessary floor area of sufficient strength to support the wheels of trailers at any longitudinal location, and still is sufficiently light in overall weight to permit carriage of stacked intermodal cargo containers without undue limitation of their net cargo weight.

In a preferred embodiment of the invention the side sills include a deep rectangular top chord and a web of relatively thin material extending diagonally down to a well floor assembly. The well floor assembly is attached to the web continuously along its length, so that the well floor acts as a lower chord for the side sill, but is suspended beneath the top chord of the side sill along the entire length of the well floor.

In such an embodiment of the invention, because the thin web extending diagonally down is located to carry primarily tension loads, it is not subject to buckling and no side posts are required in the side sill as in less efficient car construction. The avoidance of side posts reduces weight, cost and the presence of welds transverse to the principal stress direction.

Lateral loads from the cargo are substantially carried by the stiff floor structure and are substantially transferred to the ends of the car, not carried via the side sill webs or side posts as in previous well cars.

In one embodiment of the invention the well floor structure has a horizontal bottom plate, longitudinally extending channel members of a special configuration located along the lateral margins of the bottom plate, and a centrally located horizontal top plate spaced upwardly apart from the bottom plate. In such an embodiment of the invention large openings are provided in both the bottom plate and the top plate, with a stiffening member extending around the periphery of each large opening and interconnecting the top plate with the bottom plate.

In one embodiment of the invention transverse channel members extend laterally, between the top and bottom plates of the well floor, at longitudinally apart-spaced locations.

In one embodiment of the invention the well floor includes end transition portions through which the forces imposed by the lading of the car and other forces resulting from the operation of the car as a part of a train are carried between the end portions of the car body and the portions of the floor incorporating the lightweight structure.

It is therefore a principal object of the present invention to provide an improved railroad freight car body defining a shallow well for carrying optionally either cargo containers or trailers on wheels.

It is another object of the present invention to provide such a car having a well floor structure of adequate strength, yet with reduced weight and thickness.

It is a further object of the present invention to provide such a well car having a car body having a unified structure including side sills interconnected with such a well floor to provide a strong yet light car body.

It is an important feature of a preferred embodiment of the present invention that it includes a longitudinal transition channel providing a strong interconnection of a main portion of a well floor assembly with each of a pair of side sills of the car body.

It is another feature of a preferred embodiment of the present invention that it provides a well floor structure which is shallow in vertical height and which includes parallel top and bottom plates which define large openings and are interconnected with each other around the periphery of each such large opening.

The foregoing and other objectives, features, and advantages of the invention will be more readily understood upon consideration of the following detailed description of the invention, taken in conjunction with the accompanying drawings.

DETAILED DESCRIPTION OF A PREFERRED EMBODIMENT

Figure 1:
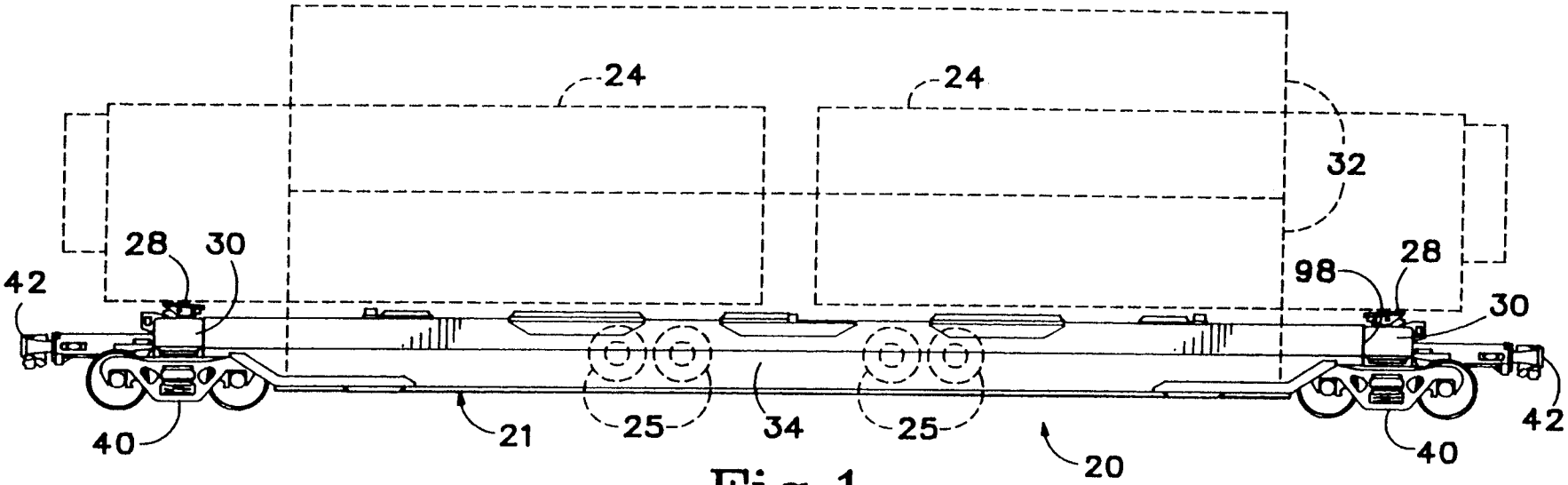
FIG. 1 is a side elevational view of a railroad freight car embodying the present invention and laden with a pair of semi-trailers carried in a cargo well defined in the car body.
Figure 2:
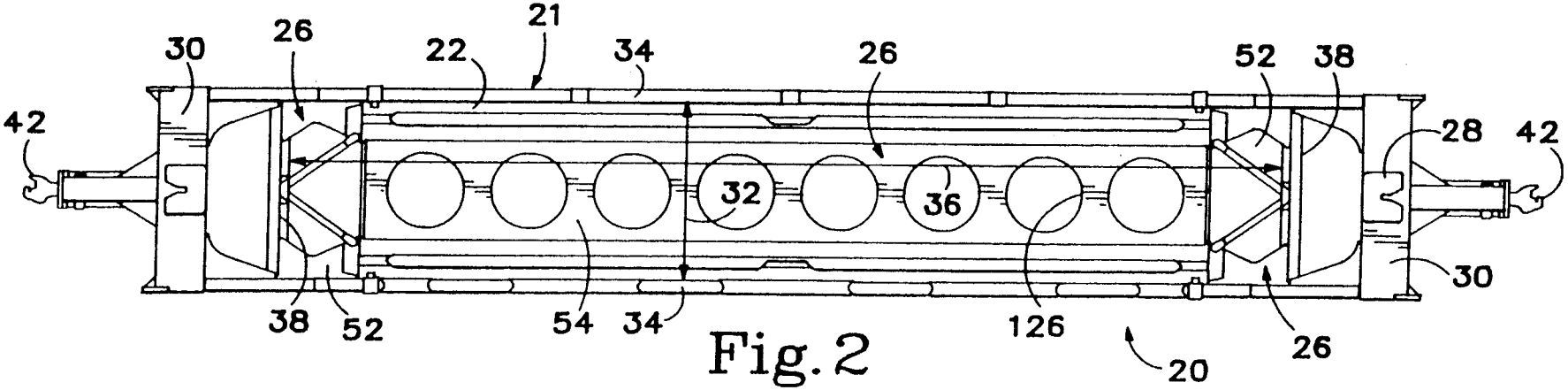
FIG. 2 is a top plan view of the railroad car shown in FIG. 1.

Referring first to FIGS. 1 and 2 of the drawings which form a part of the disclosure herein, a railroad freight car 20 has a car body 21 of welded steel which includes a cargo well 22 adapted to be laden by receiving trailers 24. As shown in phantom line in FIG. 1, the wheels 25 of the trailer rest on a floor assembly 26 which helps to define the cargo well 22, and a kingpin portion near the front of each trailer 24 is secured to and supported on a fifth wheel trailer hitch 28 mounted atop a body bolster 30 located at a respective end of the car 20. Alternatively, intermodal cargo containers 32, also shown in phantom line in FIG. 1, may be carried in the cargo well 22, where two of such cargo containers can be stacked one upon another, supported by the floor assembly 26, within the vertical clearance space available along most railroads.

The well 22 has a width 32, defined between a pair of opposite side sills 34, and a length 36, defined between a pair of vertical transverse stiffeners 38. The length and width are great enough to receive a cargo container having a long standard length, such as 48 feet, and a wide standard width such as 102 inches, or to receive a pair of short standard containers each 20 feet long.

A conventional four-wheeled truck 40 located under each body bolster 30 supports the car 20 on a railroad track (not shown), and conventional couplers 42 are provided at the ends of the car 20.

As may be seen in FIGS. 3–8, each of the side sills 34 includes a deep rectangular top chord 44 in the form of a longitudinal channel 45 of bent plate, ⅝ inch thick, for example, including a pair of flanges 46, extending horizontally outward. A ¼-inch-thick (for example) web plate 48 of the side sill 34 is welded to the flanges 46 extending vertically between them to close the top chord 44 and extends thence diagonally downwardly and inwardly as a lower panel 50 acting as a web of the side sill 34. A reinforcing angle member 49 welded to the plate 48 extends horizontally between the flanges 46 to reinforce the top chord 44 against buckling without adding an undesirable amount of weight. The lower panels 50, however, are essentially planar between the point of attachment to the respective lower flange 46 and lower margins of the panels 50, and thus carry bending forces from the floor assembly into the top chords 44 of the side sills 34. The side sills 34, thus, are very clean structurally with no additional major reinforcement members.

The well floor assembly 26 is of welded metal construction and is attached to and supported by lower panels 50 of the side sills 34, extending horizontally between them. Opposite end transition portions 52 of the floor assembly 26 are also attached to the lower panels 50 as well as to the vertical transverse stiffeners 38 which define the length 36 of the well 22. The end transition portions 52 carry longitudinal loads from the main portion 54 of the floor assembly 26 to the side sills 34 and to the transverse stiffeners 38 at each end of the car body 21.

Between the well floor end transition portions 52, the main portion 54 of the well floor assembly 26 is an integral rigid welded assembly, including a bottom plate 56 which may be in the form of two opposite side portions each about half the width of the floor assembly 26, extending horizontally for the length of the main portion 54 of the floor assembly 26 and joined together along a longitudinal center joint. The bottom plate 56 may be, for example, 3/16 inch thick.

A longitudinally extending transition channel member 58, of bent plate 7/16 thick, for example, extends along the top of each lateral margin of the bottom plate 56. The transition channel members 58 are specially configured, with a cross-section shape that includes a V-shaped channel portion 60 which has a pair of sides including a diagonally upwardly-and-outwardly directed outer flange portion 62. As may be seen best in FIG. 5, a bottom portion of the V-shaped channel 60 is welded to the lateral margin 64 of the bottom plate 56, while an upper margin of the outer flange portion 62 overlaps and is welded to the inner side of a lower margin 66 of the lower panel 50 of the web sheet 48, so that the floor assembly 26 is suspended from the top chords 44 and extends horizontally between the two side sills 34. Each transition channel member 58 further includes a horizontal transverse portion 68 connected with the other side of the channel 60, and a vertical flange portion 70 extending down from the transverse portion 68 and whose margin is welded to the top side of the bottom plate 56. Thus, the transition channel members 58 resemble a radical, or square root, sign.

The well floor end transition portions 52 each include a pair of transition plates 72 forming the lateral margins of the end transition portions 52. The transition plates 72 are 7/16 inch thick, for example, and extend from each end of the main portion 54 of the floor assembly 56 toward the respective vertical transverse stiffener member 38. Each transition plate 72 is welded to the inwardly extending transverse horizontal lower flange 74 of the respective stiffener 38, as may be seen best in FIG. 3.

A pair of diagonal box beams 76 extend from respective portions of the transition plates 72 adjacent the main portion 54 of the floor assembly 26, converging toward each other, and are welded to a central portion of the horizontal lower flange 74 of the respective transverse stiffener 38. The box beams 76 may be two inches by four inches overall in cross-section size, with a wall thickness of ⅛ inch, for example. A top cover plate 78 is welded to the tops of the beams 76. The top cover plate 78 extends down alongside the outer ends of the box beams 76 and is also welded to the flange 74 to further strengthen the attachment of the outer ends of the beams 76 to the transverse stiffener 38.

Figure 3:
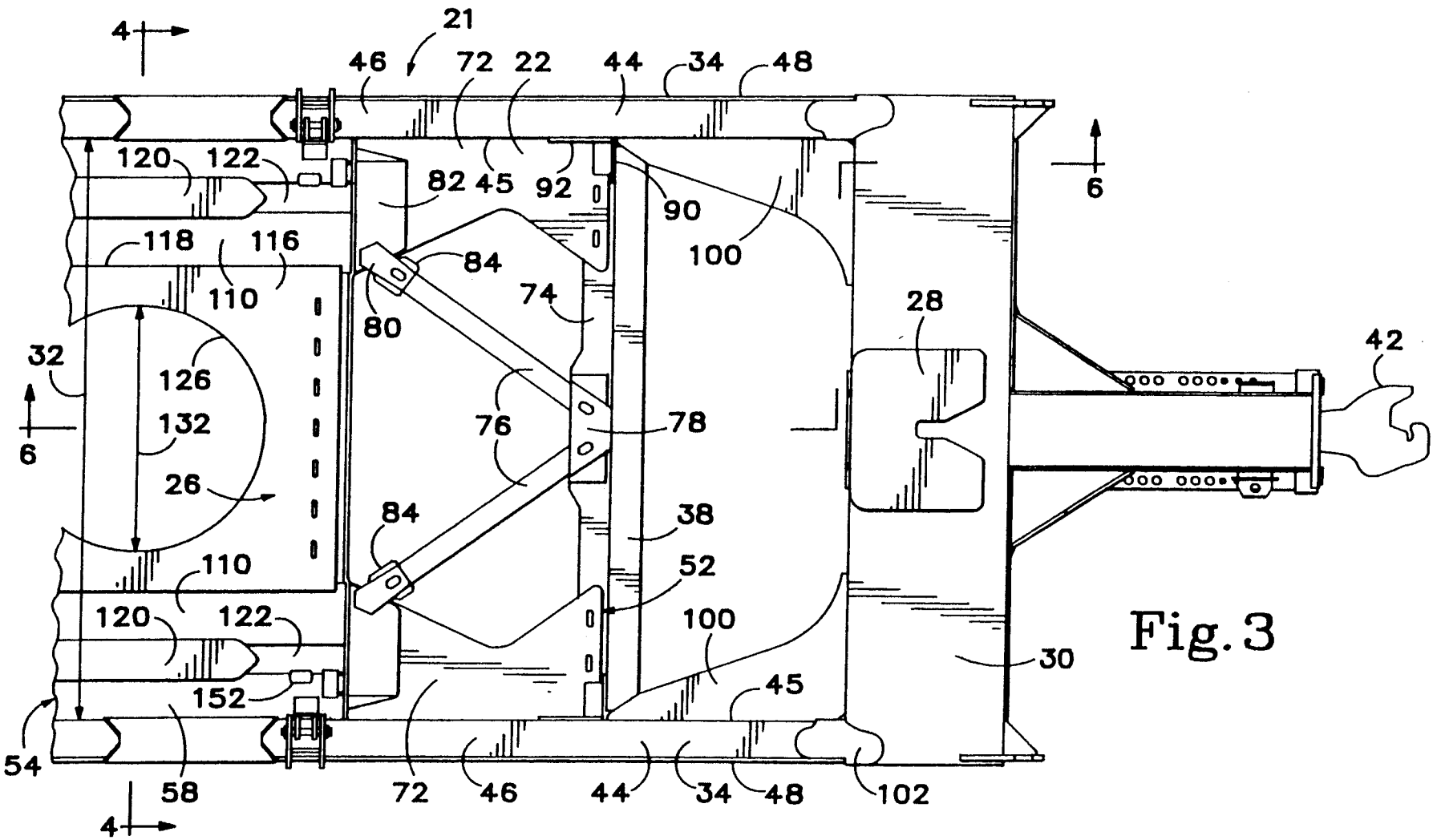
FIG. 3 is a top plan view, at an enlarged scale, of a portion of the car shown in FIGS. 1 and 2.
Figure 4:
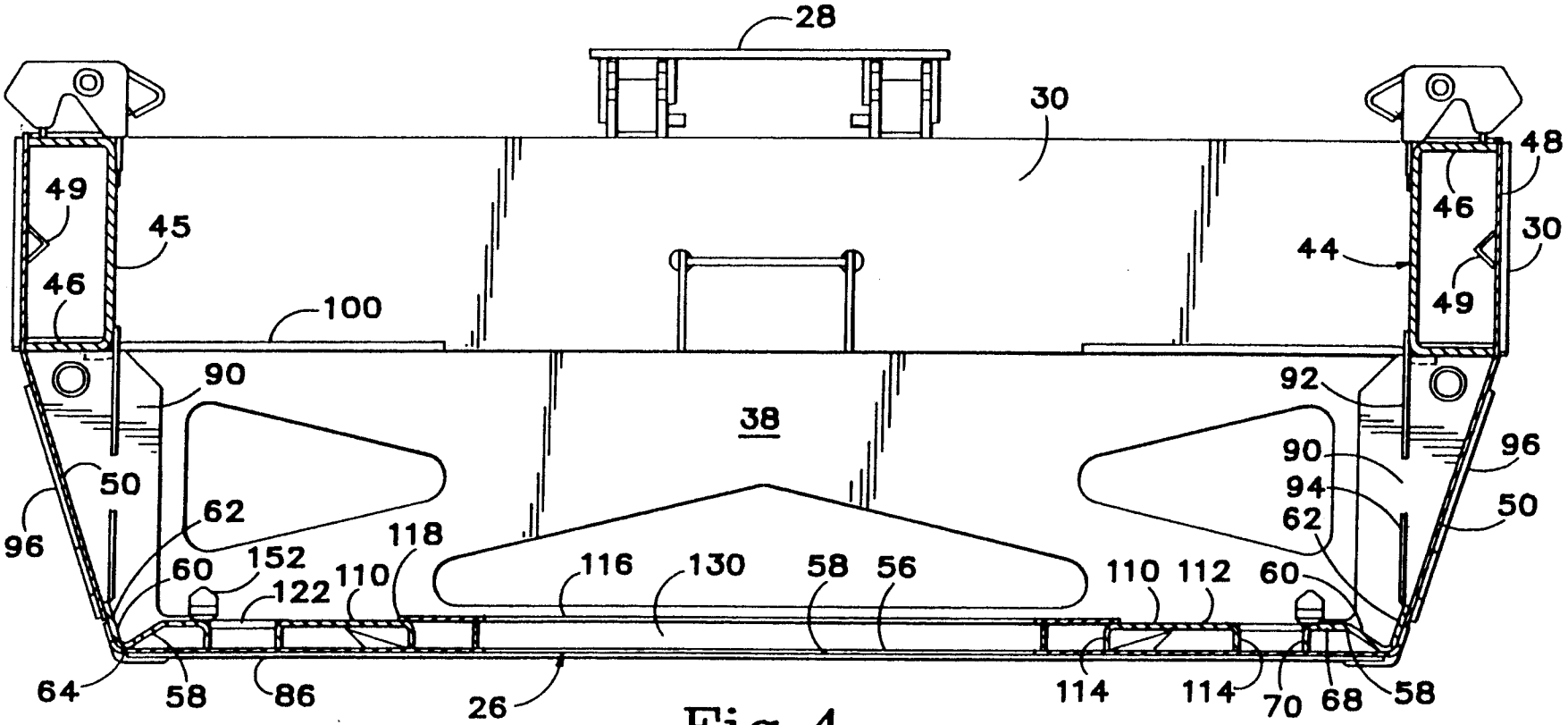
FIG. 4 is a sectional view of the body of the railroad freight car shown in FIGS. 1-3, taken along line 4—4 in FIG. 3, at an enlarged scale.
Figure 5:
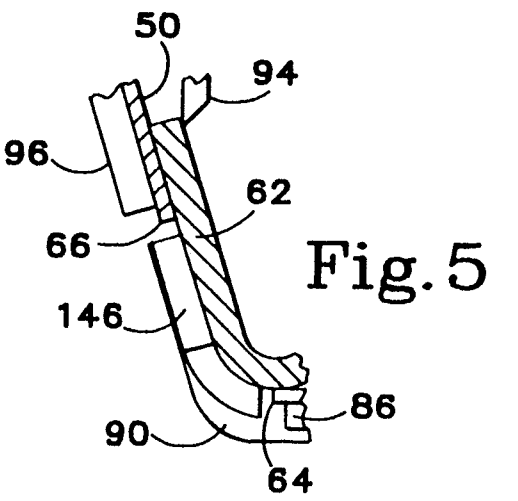
FIG. 5 is an enlarged sectional view of a detail of the portion of a railroad freight car body shown in FIG. 4.
Figure 6:
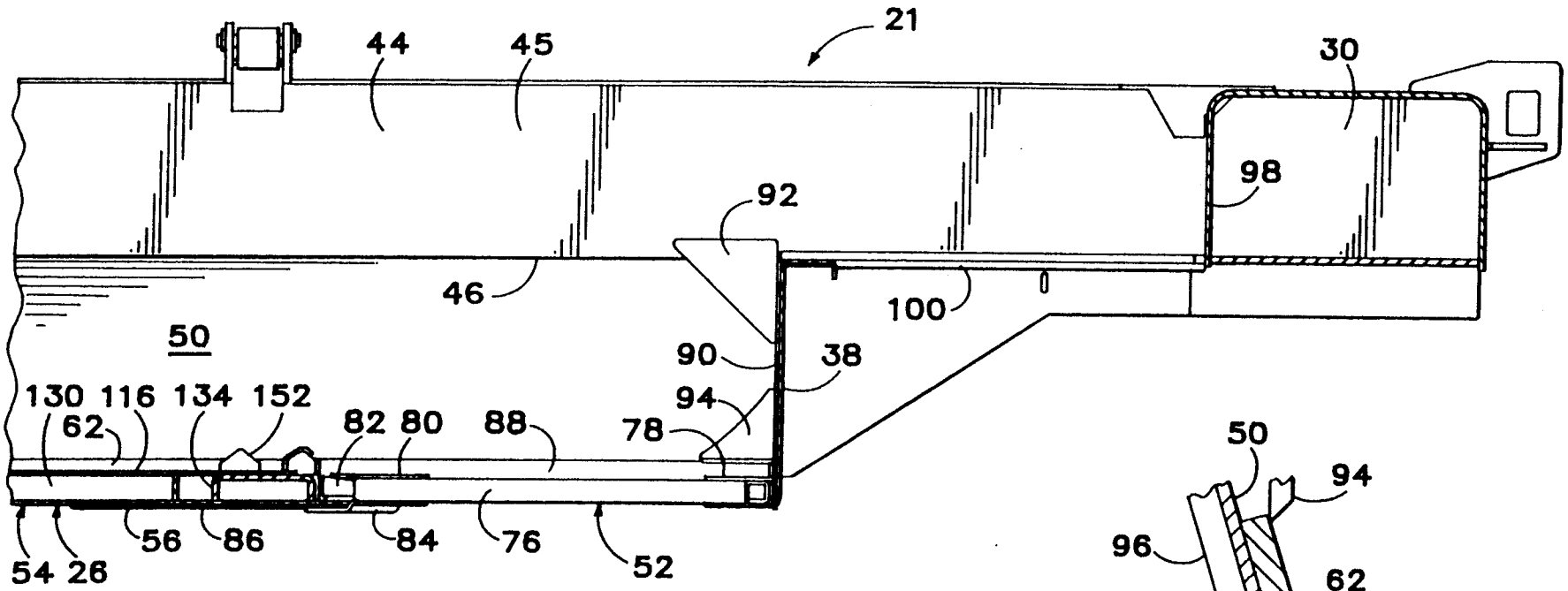
FIG. 6 is a sectional view of a portion of the body of the railroad freight car shown in FIGS. 1-3, taken along line 6—6 of FIG. 3, at an enlarged scale.
Figure 7:
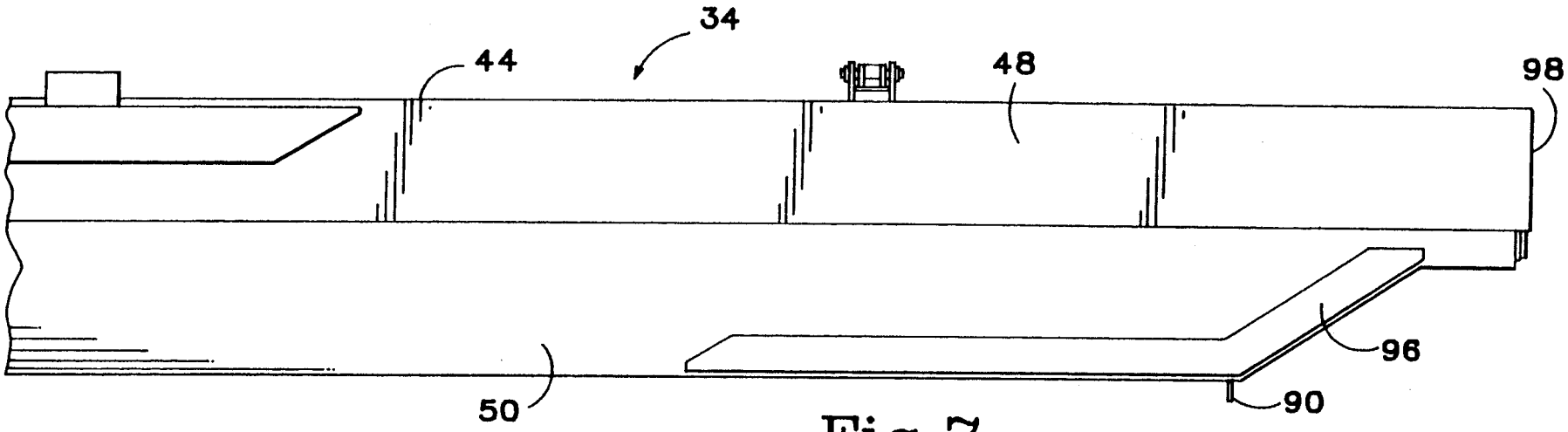
FIG. 7 is a side elevational view of a portion of a side sill of the railroad freight car shown in FIG. 1, at an enlarged scale.
Figure 8:
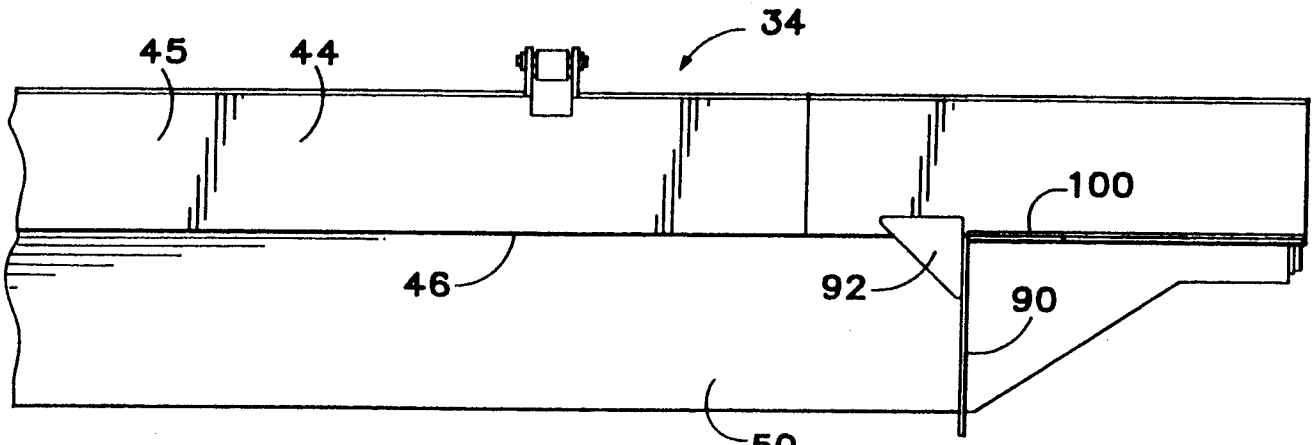
FIG. 8 is a side elevational view, at an enlarged scale, of a portion of a side sill shown in FIG. 1, taken in the direction indicated by the line 6—6 in FIG. 3.

Similarly, as shown also in FIGS. 3 and 6, a top attachment plate 80 is welded to the top of the other, or longitudinally inner, end of each of the beams 76 to attach it to the top of a respective transition ramp member 82 which forms a part of the attachment of the main portion 54 of the floor assembly 26 to the transition plate 72. A bottom attachment plate 84 also cooperates in attachment of the inner ends of the beams 76 to the transition plates 72, through a doubler plate 86 which is attached to the lower faces of the bottom plate 56 and the transition plate 72. The cover plates 78 and attachment plates 80 and 84 may all be 3/16 inch thick, for example.

A diagonally upwardly-and-outwardly extending flange 88 is a portion of each transition plate 72 and is welded to the lower margin 66 of the lower panel 50 of the web sheet 48 to attach the laterally outer margins of the transition plates 72 to the side sills 34.

A stub transverse stiffener 90 (FIGS. 4, 6, and 8) similar in thickness to the transverse stiffeners 38 supports the lower panel 50 of each web sheet 48 beneath the top chord 44 immediately adjacent the transverse stiffener 38, and is welded to the transverse stiffener 38 to interconnect it securely with the side sills 34 and define the end of the cargo well 22. A gusset 92 of similar material interconnects the stub transverse stiffener 90 with the channel 45 of the top chord 44, and a gusset 94 interconnects the upper margin of the outer flange portion 62 of the transition channel member 58 with the stub transverse stiffener 90.

The outer ends 98 of the side sills 34 are welded to each of the body bolsters 30. The body bolsters 30 are transversely-extending box beam structures similar to those used in other railroad well cars of recent design for carrying stacked intermodal cargo containers. The longitudinally outer portions of the lower panel 50 of each side sill 34, the portions extending beyond the transverse stiffeners 38, are diagonally tapered upwardly toward the top chord 44, providing clearance for the truck 40. A doubler plate 96 is provided on the outer side of the lower panel 50 to reinforce the margins of the lower panel 50 on each side of the transverse stiffeners 38.

Large, generally triangular, horizontal gusset plates 100 extend from the top flange of the transverse stiffener 38 to the lower portion of the body bolster 30. The gusset plates 100 carry substantial loads to the body bolster 30, and are therefore of substantial thickness, for example ¾ inch. An outer side margin portion of each gusset 100 extends beneath and is welded to the lower flange 46 of the respective top chord channel member 45, as seen best in FIG. 4. Reinforcing plates 102 strengthen the interconnection of the top flange 46 of the chord 44 of each side sill to the body bolsters, as shown in FIG. 3.

Referring now also to FIGS. 9–17, the longitudinally centrally located main portion 54 of the floor assembly 26 includes a pair of downwardly-open longitudinal channels 110, extending longitudinally of the floor assembly 26, each spaced laterally inward from and parallel with a respective transition channel member 58. Each longitudinal channel 110 may be of bent plate 7/16 inch thick, for example, and has a horizontal web 112 and a pair of vertical flanges 114 of equal size so that the web 112 is parallel with the bottom plate 56. The height of the longitudinal channels 100 is equal to that of the horizontal portion 68 of the longitudinal transition channels 58.

A generally rectangular top plate 116 extends horizontally between the longitudinal channels 110 and has its lateral margins 118 welded respectively to the inboard shoulder of the downwardly open longitudinal channel 110 on each side, so that the top plate 116 of the floor assembly 26 is spaced upwardly apart from the bottom plate 56 by a distance equal to the height of the longitudinal channel 110.

A cover plate 120, 7/16 inch thick, for example, is welded atop the confronting shoulders of each transition channel 58 and the nearby downwardly open longitudinal channel 110 to form an upper surface. The cover plate 120 is additionally supported by heavy doubler plates 122 ⅜ inch thick, for example, located between the confronting vertical flanges 114 and 70 at the positions along the length of the floor assembly 26 where concentrations of weight are to be expected. Doubler plates 122 are thus provided where the ends of a pair of end-to-end cargo containers are to be supported at the mid point of the length 36 of the well 22, and at the ends of the main portion 54 of the floor assembly 26, adjacent the transition plates 72, where the corner posts of the outer ends of containers are to be supported on locator cones. At the locations where the container corner castings are to be located the cover plate 120 is omitted, to provide a small amount of additional clearance.

The transition channel member 58, the cover plate 120, the doubler plate 122, and the longitudinally extending channel 110 all cooperate with the lower panel 50 of the web sheet 48 of the respective side sill 34 to carry loads which would be carried by a lower chord of the side sill 34 if one existed. Additionally, the horizontal transverse portion 68 of the transition channel members 58, the cover plates 120, and the horizontal webs 112 of the longitudinal channels 110 include suitably strong upper surfaces of the floor assembly 26 to support the wheels 25 of trailers 24 carried in the well as shown in FIG. 1.

Figure 10:
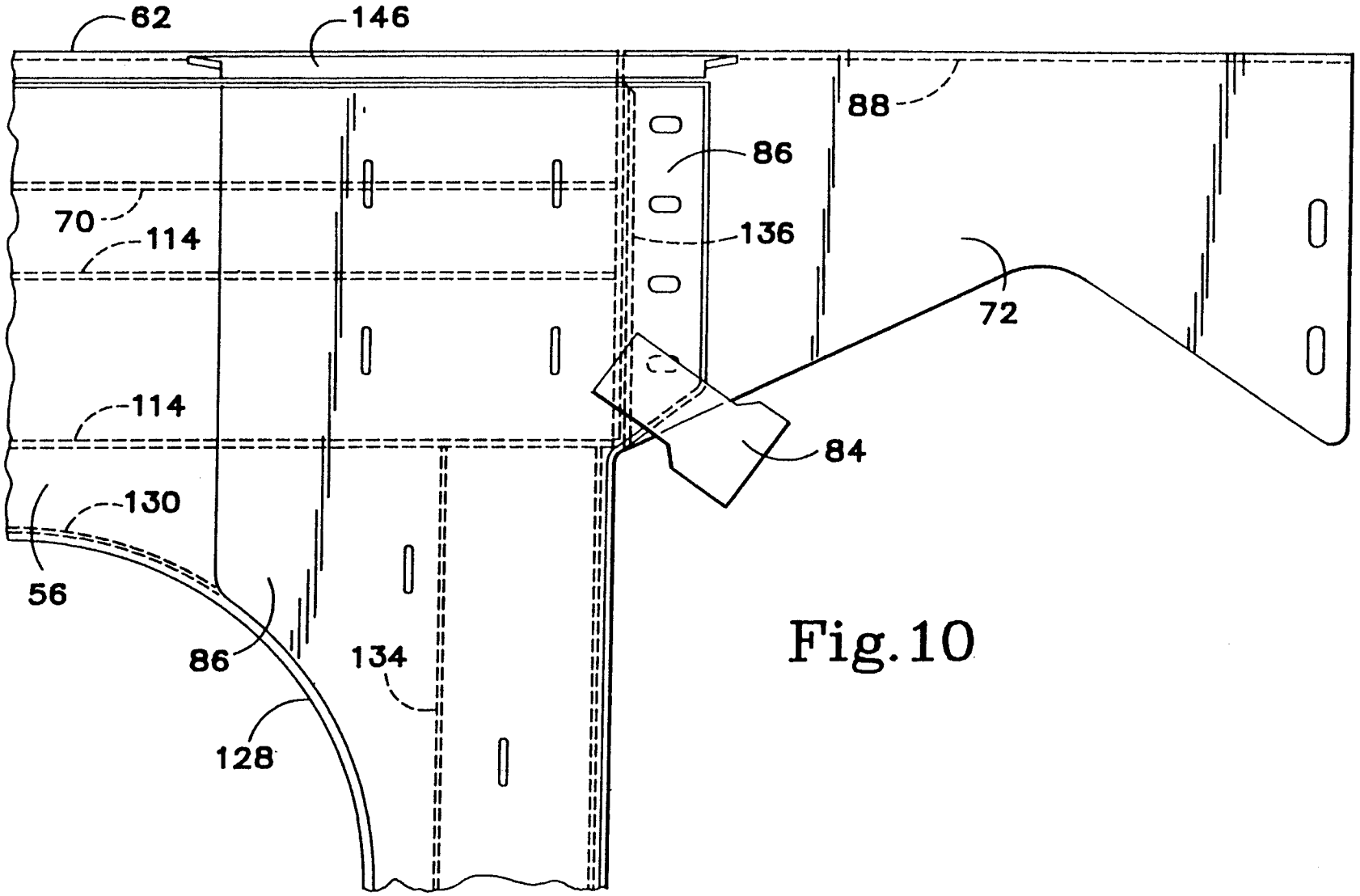
FIG. 10 is a bottom view of part of the portion of a well floor assembly shown in FIG. 10.
Figure 11:
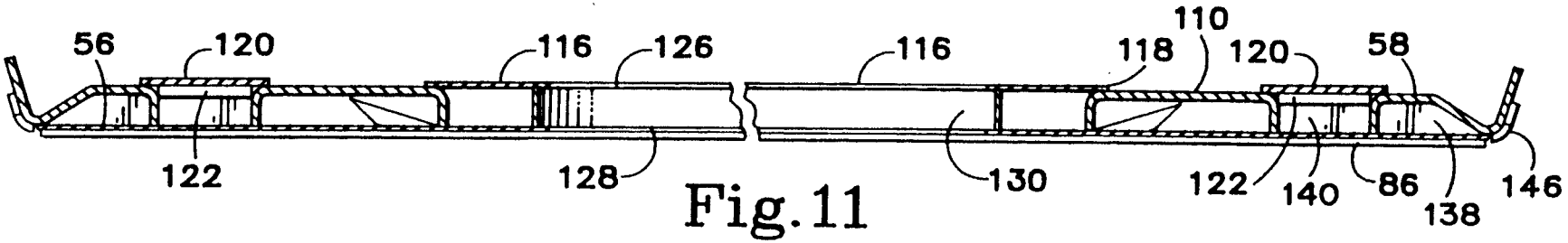
FIG. 11 is a sectional view, at an enlarged scale, of a portion of the well floor assembly shown in FIG. 9, taken along line 11—11.
Figure 12:
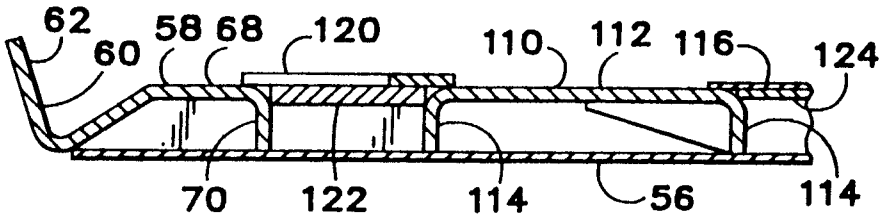
FIG. 12 is a sectional view, at an enlarged scale, of a portion of the well floor assembly shown in FIG. 9, taken along line 12—12.
Figure 13:
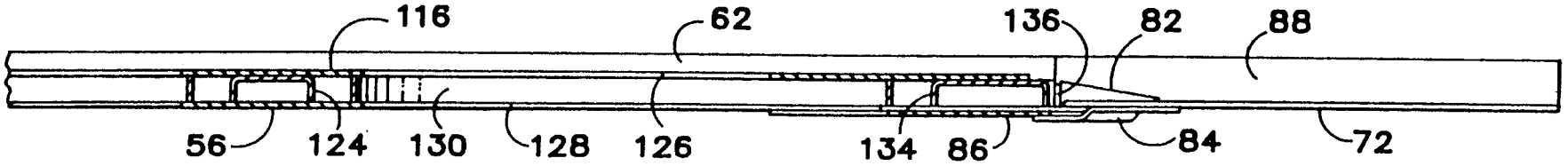
FIG. 13 is a sectional view, at an enlarged scale, of a portion of the well floor assembly shown in FIG. 9, taken along line 13—13.

The floor assembly 26 is further strengthened by several transversely extending beams in the form of downwardly-open channels 124, of bent plate 5/16 inch thick, for example, whose flanges are welded to the bottom plate 56 at locations spaced apart longitudinally along the main portion 54 of the floor assembly 26. The top plate 116 is welded to the web of each transverse channel 124 through conventional openings provided for that purpose. A similar but wider transversely extending end channel 134 is located at each end of the main portion 54 of the floor assembly, as shown in FIGS. 6 and 10.

In order to provide additional stiffness while also reducing the weight of the bottom assembly 26, the bottom plate 56 and the top plate 116 each respectively define several large openings 126 and 128, preferably circular in shape, of equal size, and located directly above one another. A stiffener 130 extends vertically between the bottom plate 56 and top plate 116 and surrounds the large openings 126 and 128. The stiffener 130 is of metal plate material ¼ inch thick, for example, forming a circular wall enclosing the large openings 126 and 128. The stiffener 130 is welded to both the bottom plate 56 and top plate 116 about the entire periphery of the large openings 126 and 128, interconnecting the top plate 116 and the bottom plate 56 as a stiff structure. The height of the longitudinal channels 110, establishing the distance separating the bottom plate 56 from the top plate 116, may be 2 9/32 inch, for example, and the stiffener 130 correspondingly would have a height of 2¼ inches.

In a car 20 in which the length 36 of the well 22 is slightly greater than 48 feet, in order to receive a nominally 48-foot-long cargo container, preferably eight sets of corresponding vertically aligned large openings 126, 128 are provided, each having a diameter 132 of 44 inches, with the circular stiffeners 130 having an inside diameter of 45 inches, providing an overhang of about ½ inch of the margins of the top plate 116 and bottom plate 56 inside the stiffeners 130 to allow for convenient welding and stress relief.

As shown also in FIGS. 9, 10, 12 and 13, the transverse channel members 124 are located between the adjacent pairs of large openings and the similar, but wider, transverse end channels 134 are located between the top plate 116 and bottom plate 56 at each end of the main portion 54 of the floor assembly 26, adjacent the well floor end transition portions 52.

In order to provide adequate strength for transfer of loads from the main portion 54 of the well floor assembly 26 to the end transition portion 52 at each end, and ultimately to the body bolster 30, a respective doubler plate 86 is welded to the underside of the bottom plate 56 adjacent each end of the main portion 54, extending about two feet toward the center of the length of the car body 21. A portion of the doubler plate 86 extends longitudinally outward beyond the wide transverse end channel member 134 at each end of the main body portion 54 and is welded to the bottom side of the respective transition plate 72 at each side of the floor assembly 26. The respective bottom attachment plate 84 for each diagonal box beam 76 is bent to fit closely along the bottom side of the doubler plate 86 and extends thence along the bottom side of the transition plate 72.

An end cap 136 extends vertically and transversely across the ends of the transition channel member 58 and the downwardly open longitudinal channel 110 on each side at each end of the main portion 54. Each transition ramp 82 is welded to the respective end cap 136 and extends slopingly from it to the top surface of the transition plate 72.

Figure 9:
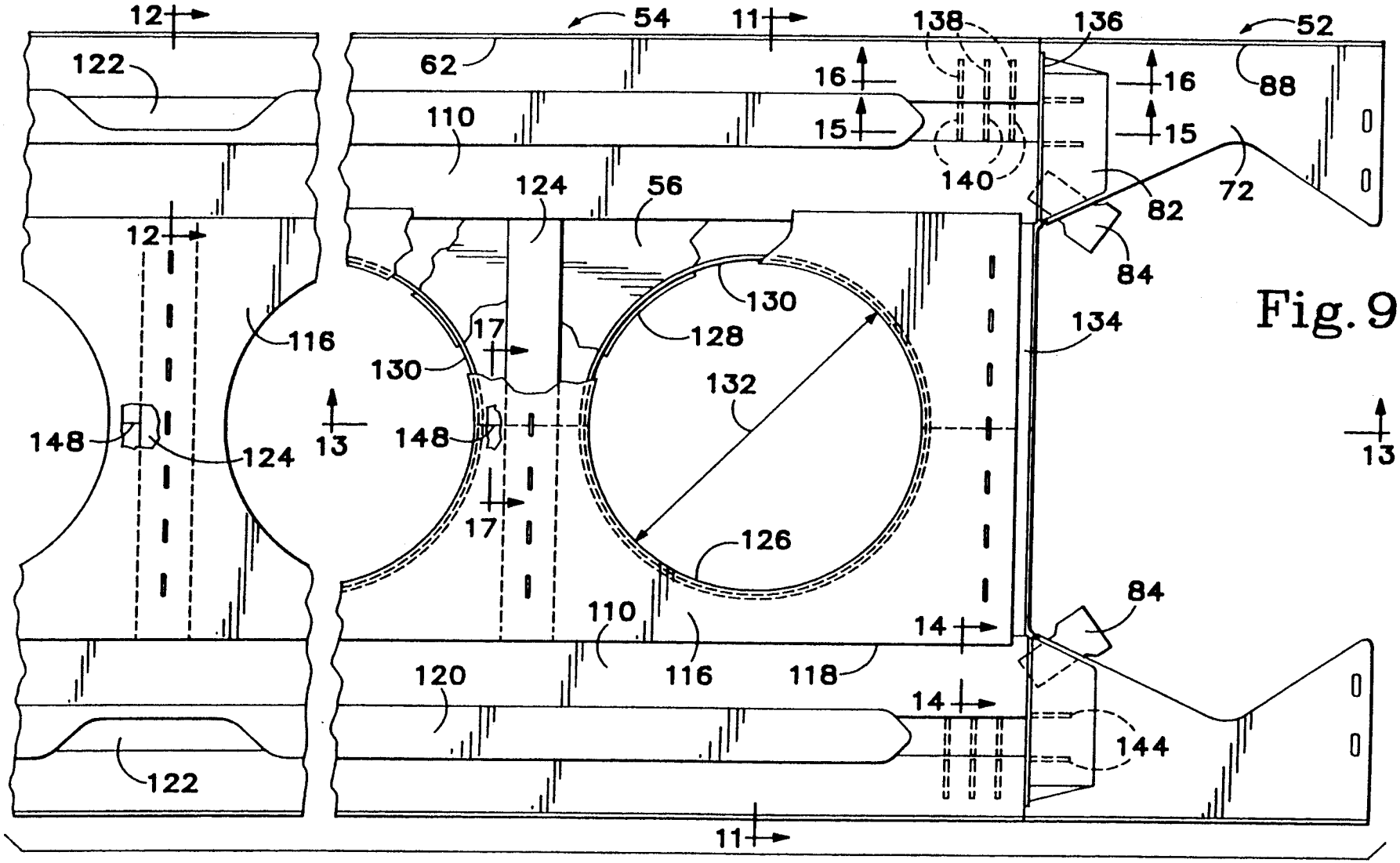
FIG. 9 is a partially cut-away, top plan view, at an enlarged scale, of a portion of the well floor assembly of the railroad freight car shown in FIGS. 1-3.
Figure 15:
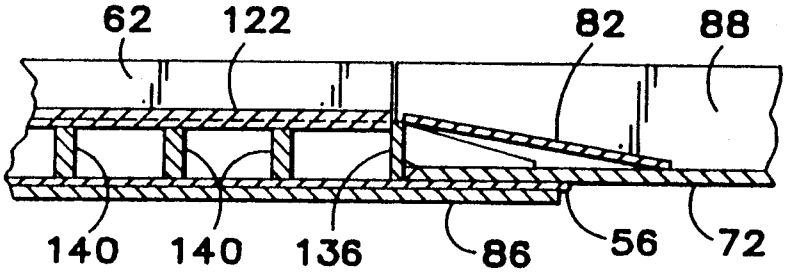
FIG. 15 is a sectional view, at an enlarged scale, of a portion of the well floor assembly shown in FIG. 9, taken along line 15—15.
Figure 14:
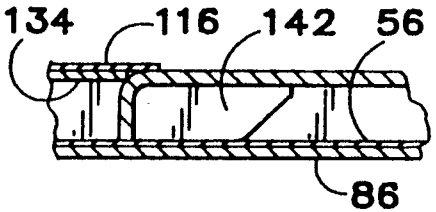
FIG. 14 is a sectional view, at an enlarged scale, of a portion of the well floor assembly shown in FIG. 9, taken along line 14—14.
Figure 16:
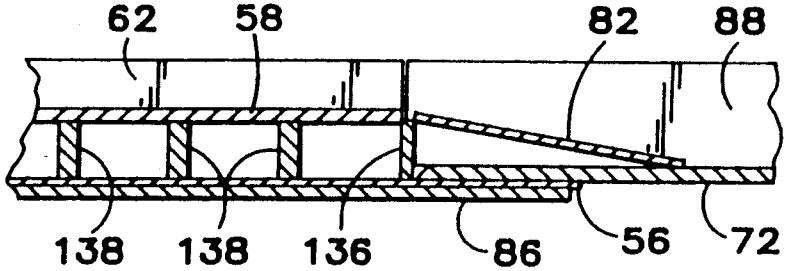
FIG. 16 is a sectional view, at an enlarged scale, of a portion of the well floor assembly shown in FIG. 9, taken along line 16—16.

Groups of transverse reinforcing pieces 138 and 140 extend vertically between the bottom plate 56 and the underside of the transition channel member 58 and the doubler plate 86, respectively, near each corner of the main portion 54 of the floor assembly 26, as shown in FIGS. 9, 15, and 16. A transition plate 142, shown in FIGS. 9 and 14, provides additional support for the longitudinal channel member 110 at each end of the main portion 54, extending vertically and laterally adjacent the end cap 136.

A "J"-shaped doubler 146 is located on the outer side of the floor assembly 26, below a part of the horizontal portion of each doubler plate 96 near the lower margin of each side sill 34. The J-shaped doublers 146 extend longitudinally over a distance extending slightly beyond the doubler plate 86, and thus reinforce a portion of the outer flange 88 of each transition plate 72 and a portion of the outer flange 62 at each end of each transition channel member 58. The outer diagonal flange 88 of each transition plate 72 also aids in the transmission of forces from the main portion 54 of the floor assembly 26 to the end transition portions 52.

Figure 17:
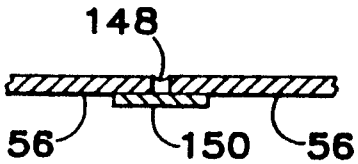
FIG. 17 is a sectional view, at an enlarged scale, of a portion of the well floor assembly shown in FIG. 9, taken along the line 17—17.

As shown in FIG. 17, except at the mid-length location along the floor assembly 26 the two longitudinally-extending halves of the bottom plate 56 are joined by a weld 148 and reinforcing a cover strip 150 extending longitudinally of the floor assembly 26 on the bottom side, at the ends of the main portion 54 and between the large openings 126 at places other than the mid-length location. However, at the mid-length position the cover strip 150 is preferably not used where track clearance height beneath the car is most critical.

Standard cargo container locator cones 152 are supported upon the reinforced portions of the corners of the main portion 54 of the well floor assembly 26, where the doubler plates 122 are not covered by the cover plates 120. At the mid-length portion of the car, between the middle pair of large openings 126, 128, the doubler plates 122 are also partially exposed as a landing spot for the corner posts of each of a pair of short containers carried end-to-end within the cargo well 22 as shown in FIG. 1.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A railroad freight car for carrying either cargo containers or trailers, comprising:

(a) a car body defining a cargo well having a length and a width;

(b) a pair of longitudinally extending opposite side sills defining said width of said well, each side sill including a web having a diagonally downward and inwardly extending lower panel;

(c) a horizontal well floor assembly extending between and supported by said side sills, said well floor assembly including a bottom plate extending over a majority of said length and a majority of said width of said well and a top plate spaced upwardly apart from said bottom plate and extending over a majority of said length and a majority of said width of said well, said well floor assembly also including a longitudinally extending transition channel member including an upwardly open V-shaped channel having a bottom and a diagonally upwardly-directed outer flange portion, said outer flange portion being welded to said lower panel of one of said side sills, and said longitudinally extending transition channel member also including a horizontal top portion attached to said V-shaped channel and extending laterally toward the other one of said pair of side sills; and (d) a plurality of vertically extending members interconnecting said bottom plate with said top plate and maintaining a vertical spacing therebetween.

2. The freight car of claim 1 wherein said car body includes an upstanding transverse stiffener extending laterally between said side sills and defining said length of said cargo well;

said well floor assembly including an end transition portion comprising a generally horizontal transition plate extending longitudinally of said car body, attached to said bottom plate and said transverse stiffener, said transition plate including a diagonally upwardly and outwardly inclined outer flange fixedly attached to said lower panel of said one of said side sills; and a downwardly inclined ramp plate extending from said top plate longitudinally of said car body toward said transverse stiffener and having an outer end fixedly attached to said transition plate.

3. The freight car of claim 1, wherein said transition channel member further includes a portion extending from said horizontal top portion downward to said bottom plate, said well floor assembly further including a downwardly open longitudinally extending channel member located laterally inward from and spaced apart from said transition channel member, said downwardly open longitudinally extending channel member having flange portions and said plurality of vertically extending members including one of said flange portions and said top plate of said well floor assembly extending laterally from said downwardly open longitudinally extending channel member.

4. The freight car of claim 3, said well floor assembly having a pair of laterally apart-spaced longitudinal sides and including one of said transition channel members and one of said downwardly open longitudinally extending channel members associated with each said side of said well floor assembly each said downwardly open longitudinally extending channel member being spaced apart from the respective one of said transition channel members, and said well floor assembly further including a cover plate extending between each downwardly open longitudinally extending channel member and the associated respective one of said transition channel members, said transition channel members, said downwardly open longitudinally extending channel members, and said cover plates all being of material having a thickness greater than that of said top plate.

5. The freight car of claim 1, wherein at least one of said top plate and said bottom plate of said well floor assembly defines a plurality of large openings and said vertically extending members include a respective stiffener plate extending about each of said large openings and attached to both of said top plate and said bottom plate.

6. The freight car of claim 5, wherein ones of said plurality of large openings are provided in both the top and bottom plates, each of said large openings being generally circular and each of said large openings in said top plate being aligned with a corresponding one of said large openings in said bottom plate.

7. The freight car of claim 6, wherein each of said large openings has a diameter equal to at least about one-third of said width.

8. The freight car of claim 1, including a plurality of transverse channel members located between said bottom-plate and said top plate of said well-floor assembly, each said transverse channel member having a horizontal web and a pair of vertical flanges, and said vertically extending members including said flanges of said transverse channel members.

9. The freight car of claim 1 wherein said well floor assembly includes a plurality of laterally separated cargo-supporting upper members, said top plate being of a relatively thin material and extending laterally between respective ones of said upper members located laterally opposite one another.

10. The freight car of claim 9, including a plurality of transverse channel members extending transversely between respective ones of said cargo-supporting upper members and located between said bottom plate and said top plate, each of said transverse channel members having a horizontal web and pair of vertical flanges, said vertically extending members including said flanges of said transverse channel members.

11. The freight car of claim 1, said well floor assembly including a pair of downwardly open longitudinally extending channel members, said channel members being located spaced laterally inwardly apart from each other and from said side sills and having downwardly directed flange portions, said plurality of vertically extending members including said flange portions.

12. The freight car of claim 11, said top plate extending laterally between said downwardly open longitudinally extending channel members, said bottom plate defining a plurality of large openings and said top plate defining a corresponding plurality of large openings each located in registration above a respective one of said large openings defined by said bottom plate, said floor assembly further including a respective stiffener plate extending peripherally about each of said large openings and interconnecting said top and bottom plates substantially completely about said large openings.

13. The freight car of claim 1, said well floor assembly including respective longitudinal side portions spaced apart laterally, said side portions being of relatively thick metal and being interconnected with each other by said top plate and said top plate being of relatively thin material, said vertically extending members including at least a pair of vertical members included in each of said side portions and extending longitudinally over a majority of said length of said well.

14. The freight car of claim 1, said well floor assembly including a pair of laterally separated upper side portions having a first thickness, said top plate extending longitudinally of said car and laterally between said upper side portions and having a second thickness that is less than said first thickness, and said bottom plate having a third thickness that is less than said first thickness.

15. A railroad freight car for carrying either cargo containers or trailers, comprising:

(a) a car body defining a cargo well having a length and width;

(b) a pair of longitudinally extending opposite side sills defining said width of said well, wherein said car body includes a pair of upstanding transverse stiffeners extending laterally between said side sills and defining said length of said cargo well;

(c) a horizontal well floor assembly extending between and supported by said side sills, said well floor assembly including a bottom plate extending over a majority of said length and a majority of said width of said well and a top plate spaced upwardly apart from said bottom plate and extending over a majority of said length and a majority of said width of said well; and said well floor assembly including an end transition portion including a generally horizontal transition plate extending longitudinally of said car body and attached to said bottom plate, to one of said transverse stiffeners, and to one of said side sills;

(d) a ramp plate, extending from said top plate longitudinally of said car body and downwardly inclined toward said one of said transverse stiffeners, and having an outer end fixedly attached to said transition plate; and (e) a plurality of vertically extending members interconnecting said bottom plate with said top plate and maintaining a vertical spacing therebetween.

16. The freight car of claim 15, said end transition portion including a pair of said transition plates laterally separated from each other, each said transition plate being attached to a respective one of said side sills.

17. The freight car of claim 16, said end transition portion further including a pair of horizontal structural members each extending diagonally inward from a respective one of said transition plates to a central portion of one of said transverse stiffeners.

18. The freight car of claim 16, said well floor assembly including respective apart-spaced lateral portions and said end transition portion further including a pair of horizontal structural members extending diagonally inward from a location on a respective one of said transition plates adjacent a respective lateral portion of said floor assembly to a central portion of one of said transverse stiffeners.

19. A railroad freight car, comprising:

(a) a car body including a pair of longitudinally extending side sills spaced apart from each other laterally, each said side sill including a top chord and a side sill web plate depending from said top chord, said side sills defining a cargo well having a width;

(b) a pair of horizontally extending longitudinal transition channel members each defining an upwardly open V-shaped channel having a bottom and a pair of side portions, including a diagonally upwardly-directed outer flange portion welded to said side sill web plate of one of said side sills, each said longitudinal transition channel member also including an inwardly-directed horizontal top portion attached to said V-shaped channel and extending horizontally inward toward the other one of said pair of side sills; and (c) a well floor assembly, including a horizontal bottom plate having an upper side, extending laterally between said longitudinal transition channel members and attached to said bottom of said V-shaped channel of each said transition channel member, and structural means for stiffening said well floor assembly connected with said upper side of said bottom plate.

20. The freight car of claim 19 wherein said outer flange of said V-shaped channel extends upward beyond said horizontal portion of said longitudinal transition channel member, said horizontal portion defining a portion of an upper surface of said floor assembly.

* * * * *